US007001221B2

(12) United States Patent
Chen

(10) Patent No.: US 7,001,221 B2
(45) Date of Patent: Feb. 21, 2006

(54) ELECTRICAL SIGNAL CONNECTOR

(75) Inventor: Michael Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 10/455,299

(22) Filed: Jun. 6, 2003

(65) Prior Publication Data

US 2004/0203291 A1 Oct. 14, 2004

(30) Foreign Application Priority Data

Apr. 11, 2003 (TW) ..... 92205710

(51) Int. Cl.
*H01R 24/00* (2006.01)

(52) U.S. Cl. ..... 439/676; 439/941

(58) Field of Classification Search ..... 439/676, 439/752, 83, 941, 344
See application file for complete search history.

(56) References Cited

U.S. PATENT DOCUMENTS

| | | | | |
|---|---|---|---|---|
| 5,586,914 | A * | 12/1996 | Foster et al. | 439/676 |
| 5,885,111 | A * | 3/1999 | Yu | 439/676 |
| 6,371,793 | B1 * | 4/2002 | Doorhy et al. | 439/404 |
| 6,394,854 | B1 * | 5/2002 | Belopolsky et al. | 439/676 |
| 6,402,561 | B1 | 6/2002 | Chen | 439/676 |
| 6,402,563 | B1 * | 6/2002 | Shi et al. | 439/676 |
| 6,506,080 | B2 * | 1/2003 | Hyland | 439/676 |
| 6,517,386 | B2 * | 2/2003 | Sakakura et al. | 439/676 |

* cited by examiner

*Primary Examiner*—Hien Vu
(74) *Attorney, Agent, or Firm*—Harness, Dickey & Pierce, PLC

(57) ABSTRACT

An electrical signal connector is disclosed such that a sideway stop part on a metal wire along with particularly designed support and depressor to prevent the wire from departure using a stop block in the hole on the depressor. The assembly of the electrical signal connector thus becomes easier. Moreover, the elastic part of the wire has a bending protruding part to increase the elasticity, ensuring the electrical connection with the network terminal plug.

14 Claims, 9 Drawing Sheets

ELECTRICAL SIGNAL CONNECTOR

BACKGROUND OF THE INVENTION

1. Field of Invention

The invention relates to an electrical signal connector for transmitting electrical signals and, in particular, to an electrical signal connector that is easy to assemble.

2. Related Art

In recent years, it is very popular to transmit data using network communication systems. As the applications become wider, the demand for high transmission efficiency requires not only better quality of connection wires but also that of electrical signal connectors. Generally speaking, the network communication path is comprised of transmission media and electrical signal connectors. The transmission media can be twisted pairs, coaxial cables, optical fibers, etc. However, the above-mentioned network communication path still has some defects such that the signal quality gets worse as the communication frequency increases. For example:

1. Near-end cross talk (NEXT): cross talk happens when two close cables have interactions through electromagnetic interference (EMI);
2. Impedance: the impedance of the transmission media has to be compatible with the system in order to efficiently transmit signals;
3. Return loss: As the impedance of the transmission system is discontinuous, reflections occur to reduce the power; and
4. Attenuation: when signals are sent through the transmission media, its strength and power are attenuated with distance.

To solve the problem that the transmission quality becomes worse as the transmission frequency gets higher, the inventor has proposed a solution as detailed in the U.S. Pat. No. 6,402,561. In that patent, several metal wires are installed inside a shell with two parallel planes inserted between adjacent wires to reduce cross talks. The distance between two metal wires on the same plane is minimized to increase the compensation. Even though the electrical signal quality is increased, each metal wire has to be put into the correct position inside the groove of the support, so that the cover can be installed. Therefore, the assembly process is complicated. Furthermore, the spring force produced by directly bending metal wires is very limited. This configuration cannot guarantee the stability of the electrical connection.

SUMMARY OF THE INVENTION

To solve the foregoing problems, the invention provides an electrical signal connector that can be more easily assembled. The invention can also guarantee the electrical connection to the network terminal plug.

The invention discloses an electrical signal connector containing a support, a depressor, and a plurality of metal conductors. Both ends of the support have several grooves. The depressor is fixed on one end and has several holes corresponding to the grooves. The metal wires are installed in the grooves on both ends of the support. Their tails are pressed by the depressor and go through the holes. An elastic part is thus formed among the grooves on both ends. Their tails have a stop part protruding sideways so that the tails go through the holes and use the stop parts to push against the sideway stop blocks formed inside the holes. This mechanism prevents the wires from departure. Moreover, one can design the elastic part to bend toward outside to enhance its elasticity, ensuring the electrical connection between the wires and the network terminal plug.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 1:
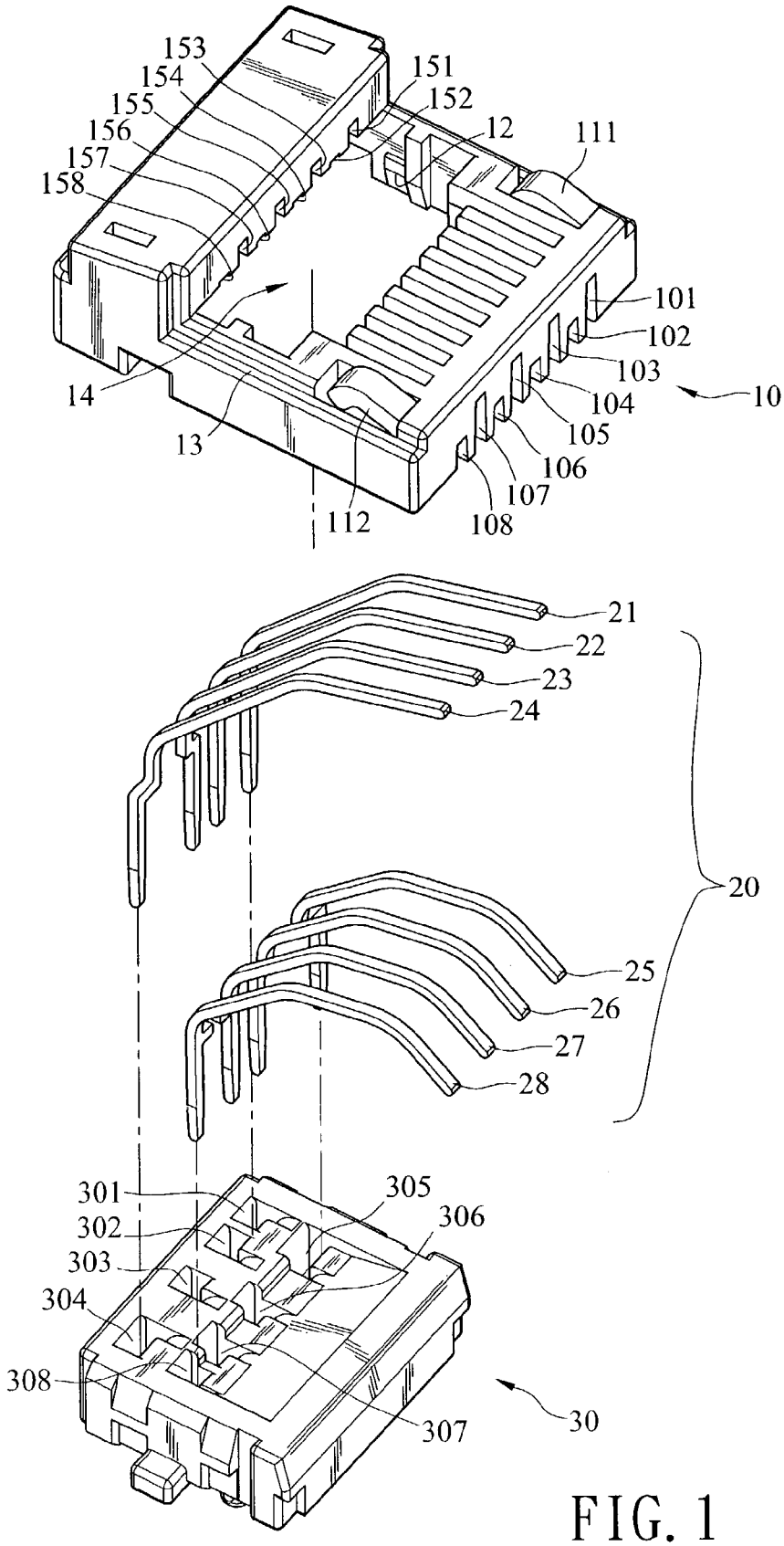
FIG. 1 is an exploded view of the invention.

As shown in FIG. 1, the disclosed electrical signal connector contains a support 10, a depressor 30 and several metal wires 20. The metal wires 20 are mostly in pairs. We use four pairs as an example in the following text to explain the spirit of the invention.

As shown in the drawing, the metal wires 20 consist of eight metal wires 21~28. Both ends of the support 10 have eight grooves, respectively. The eight grooves on the front end are 101~108, and those on the back end are 151~158. They allow metal wires 21~28 to be installed between the two sets of grooves 101~108 and 151~158. An empty space 14 is designed between the two sets of grooves for the depressor 30 to be installed. The installation can be secured using a fixing part 12 on the inner wall of the empty space 14. The fixing part has a slant surface so that the installation of the depresser 30 becomes easier. The positions on the depressor 30 that corresponding to the back end grooves 151~158 are formed with eight holes301~308 for the metal wires 21~28 to go through (see FIG. 2A).

Figure 3B:
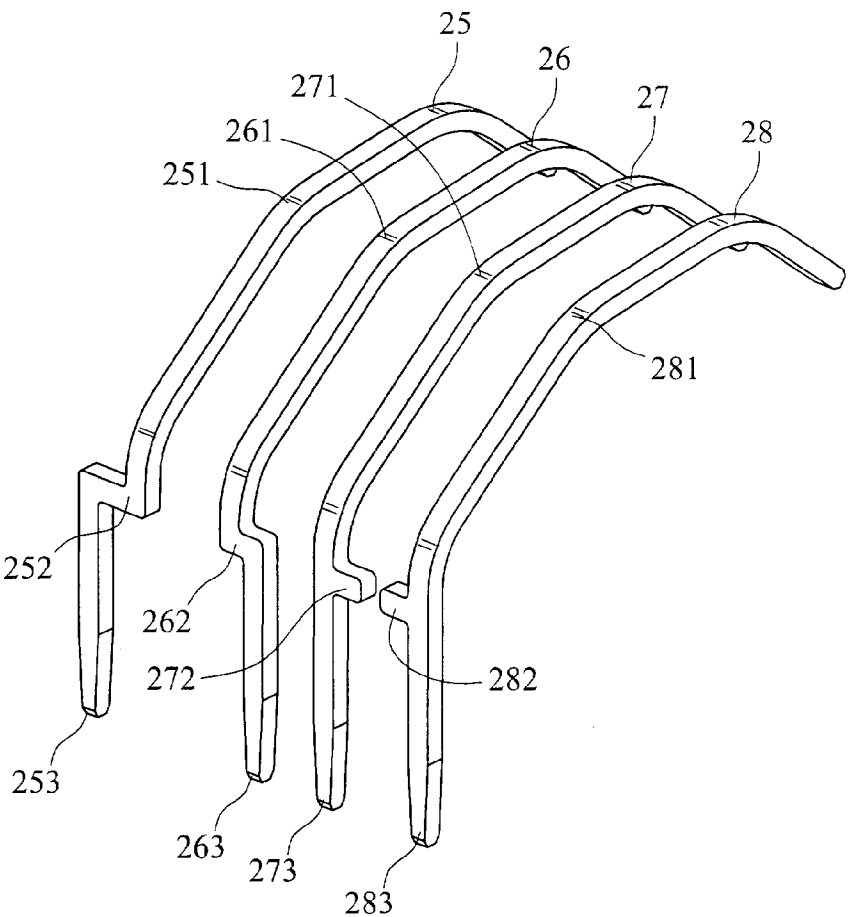
FIGS. 3A and 3B are schematic views of the disclosed metal wires.
Figure 3A:
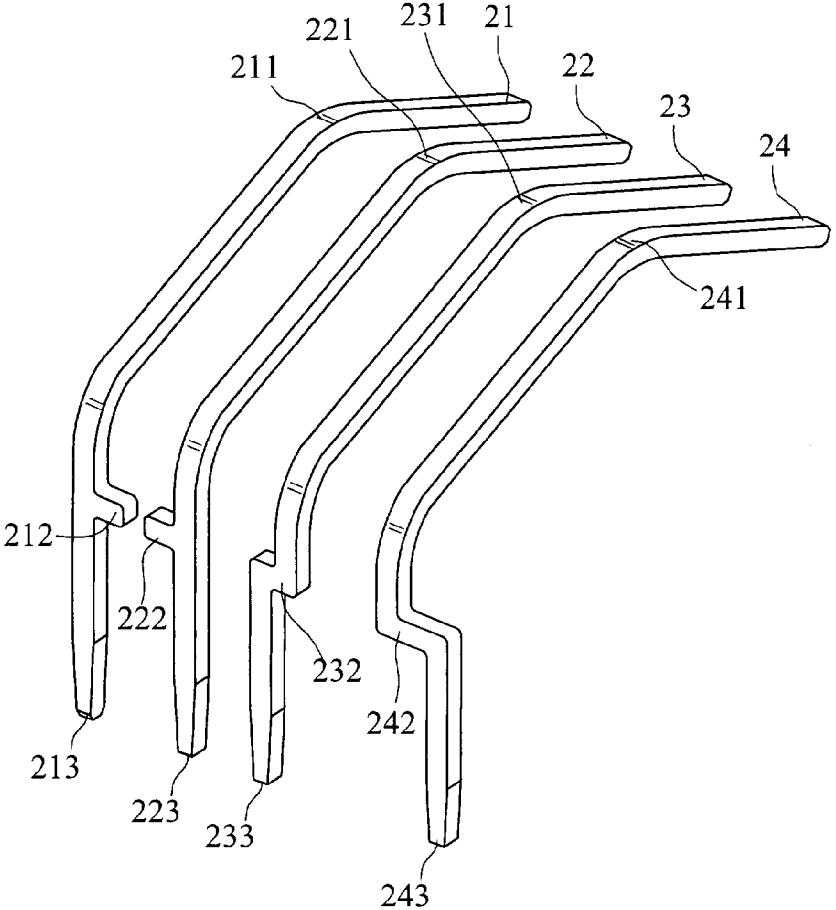

The design of the metal wires 21~28 are shown in FIGS. 3A and 3B to have stop parts 212~282 on the back end protruding sideways. The stop parts 212~282 can be formed by extension (such as 212, 222, 272, 282) or by bending sideways (such as 233, 243, 253, 263). The corresponding holes 301~308 on the depressor 30 have the corresponding sideway stop blocks 3011~3041 inside (only the stop blocks 3011~3041 of the holes 301~304 are displayed, the rest holes 305~308 have the same design).

Figure 2B:
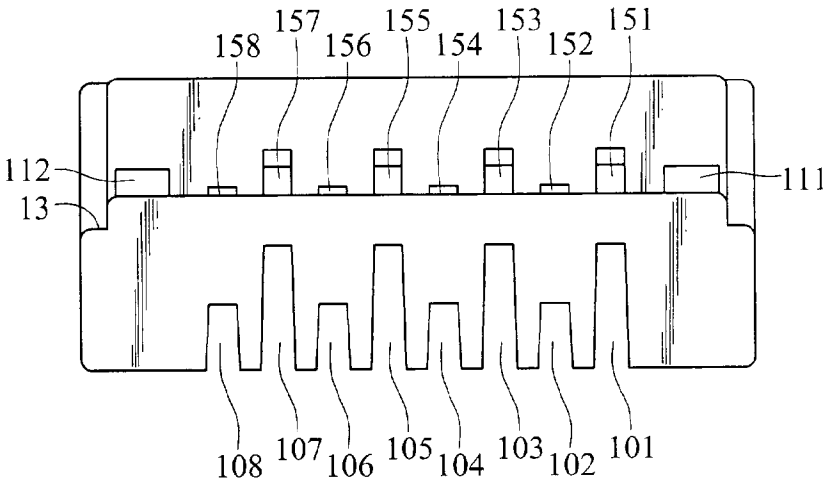
FIG. 2B is a side view of the disclosed support.
Figure 2A:
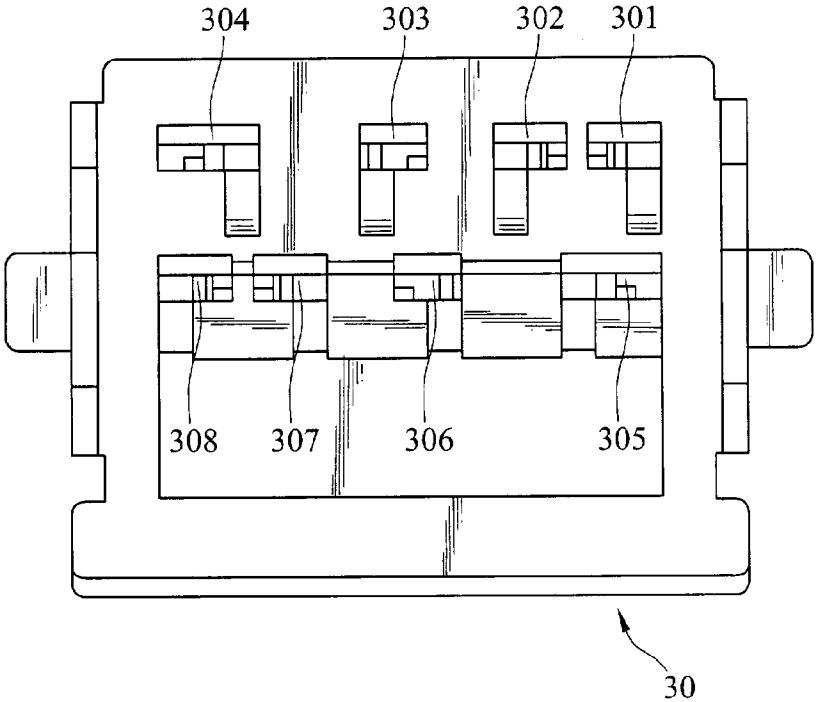
FIG. 2A is a top view of the disclosed depressor.
Figure 4B:
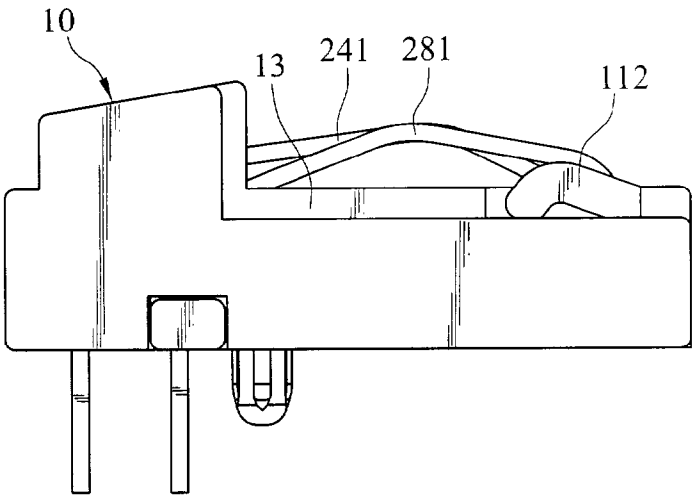
FIG. 4B is a side view of the disclosed electrical signal connector.
Figure 4A:
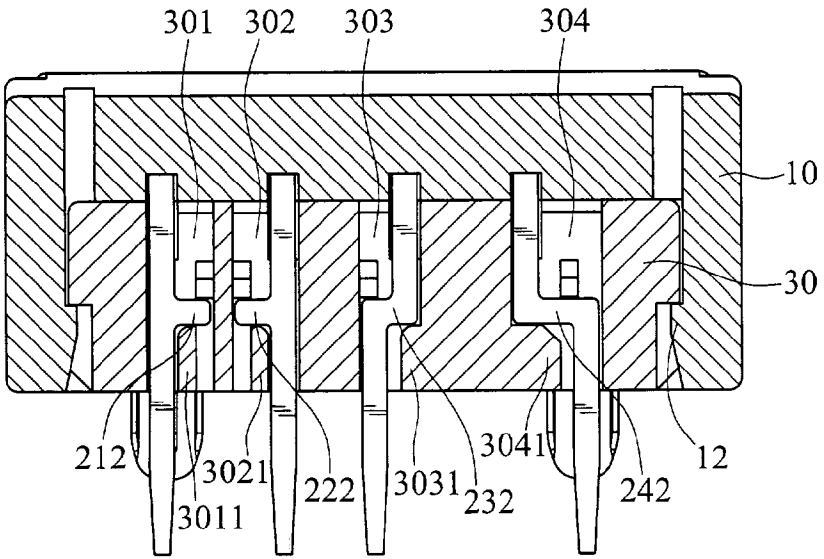
FIG. 4A is a schematic view of the stop parts of the metal wires and stop blocks in the holes.
Figure 5:
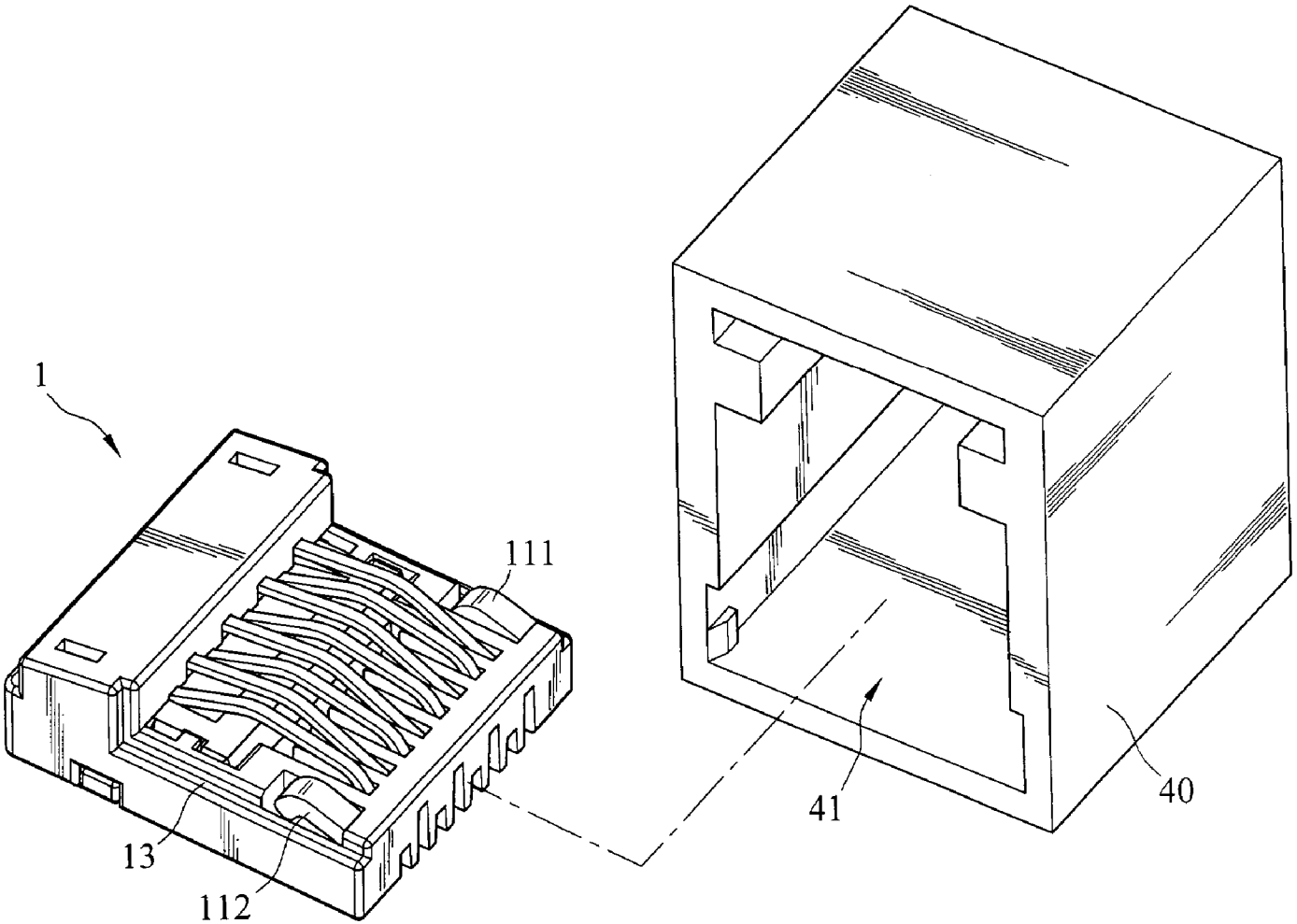
FIG. 5 is a schematic view of the invention combined with a cover.

Therefore, the front end of the metal wires 21~28 can be inserted into the corresponding grooves 101~108 on the support 10 (see FIG. 2B). Their back ends are inserted into the corresponding grooves 151~58 on the back of the support 10. One can form elastic parts 211~281 between the two sets of grooves, as shown in FIGS. 3A, 3B, and 4B. The two sets of grooves are be designed to have different depths and/or heights (see FIG. 2B) so as to fit the positions of the metal wires 21~28. The tails of the metal wires go through the holes 301~308 of the depressor 30 so that the stop parts 212~282 of the metal wires 21~28 push against the stop blocks 3011~3041 inside the holes 301~308 (FIG. 4A). The tails are exposed outside the depressor 30 to form the connecting parts 213~283. This completes the assembly of an electrical signal connector 1, as shown in FIG. 5.

The electrical signal connector 1 can be mounted inside the cover 40 using the sliding tracks 13 on both sides of the support 10 (only one being shown in the drawing) and the installation holes 41. The other side of the cover 40 has a network terminal socket (see FIG. 6) for the insertion of a network terminal plug (not shown). It is also in electrical communications with the elastic parts 211~281 of the metal wires 21~28. The support 10 has two clicking buttons 111, 112 for securing the combination of the cover 40. On the other hand, the elastic parts 211~281 are designed with at least one bend (see FIG. 4B) to enhance the elastic force of the elastic parts 211~281, ensuring the stability of the electrical connection.

Figure 6:
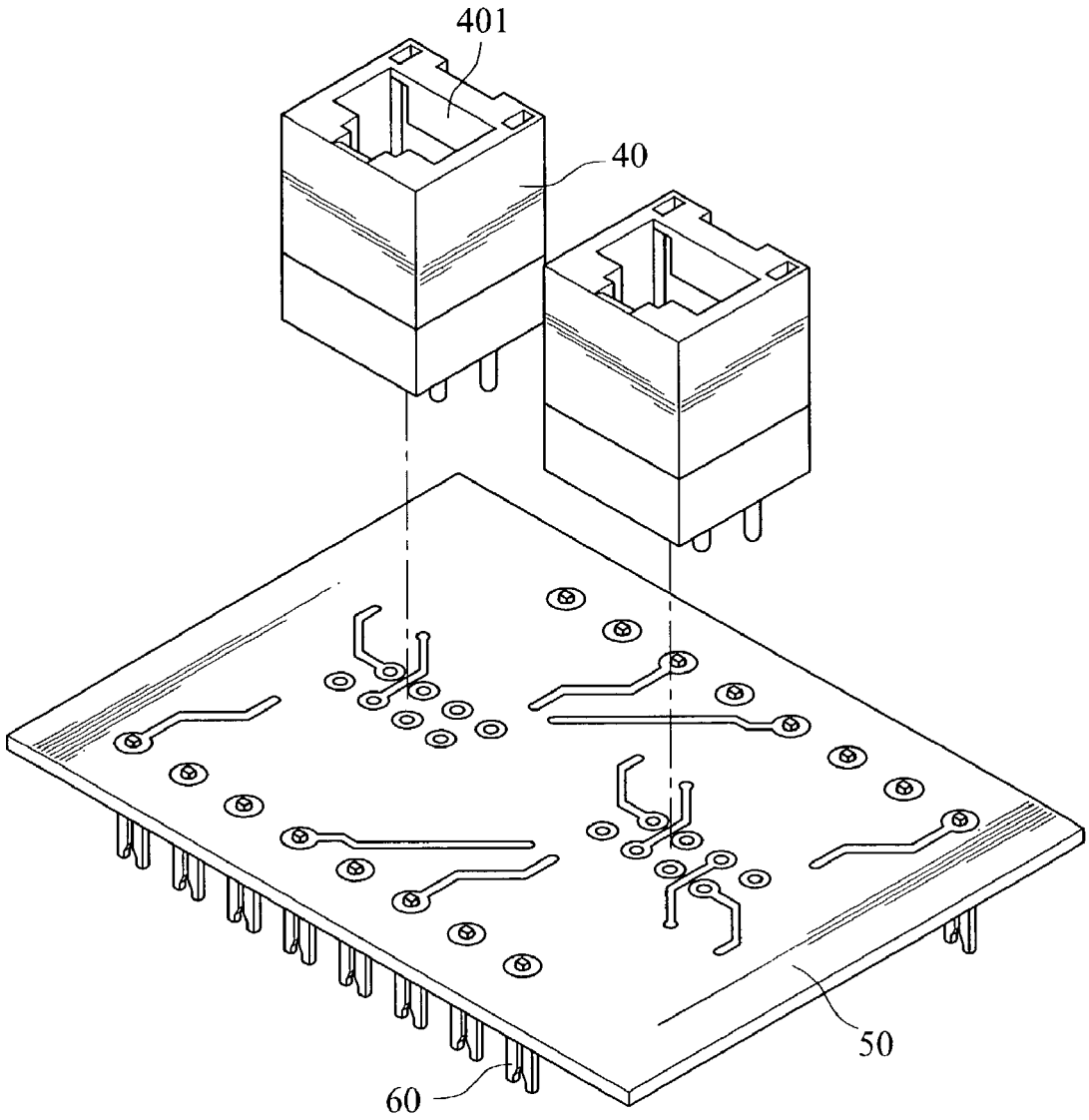
FIG. 6 shows an application of the invention.
Figure 7:
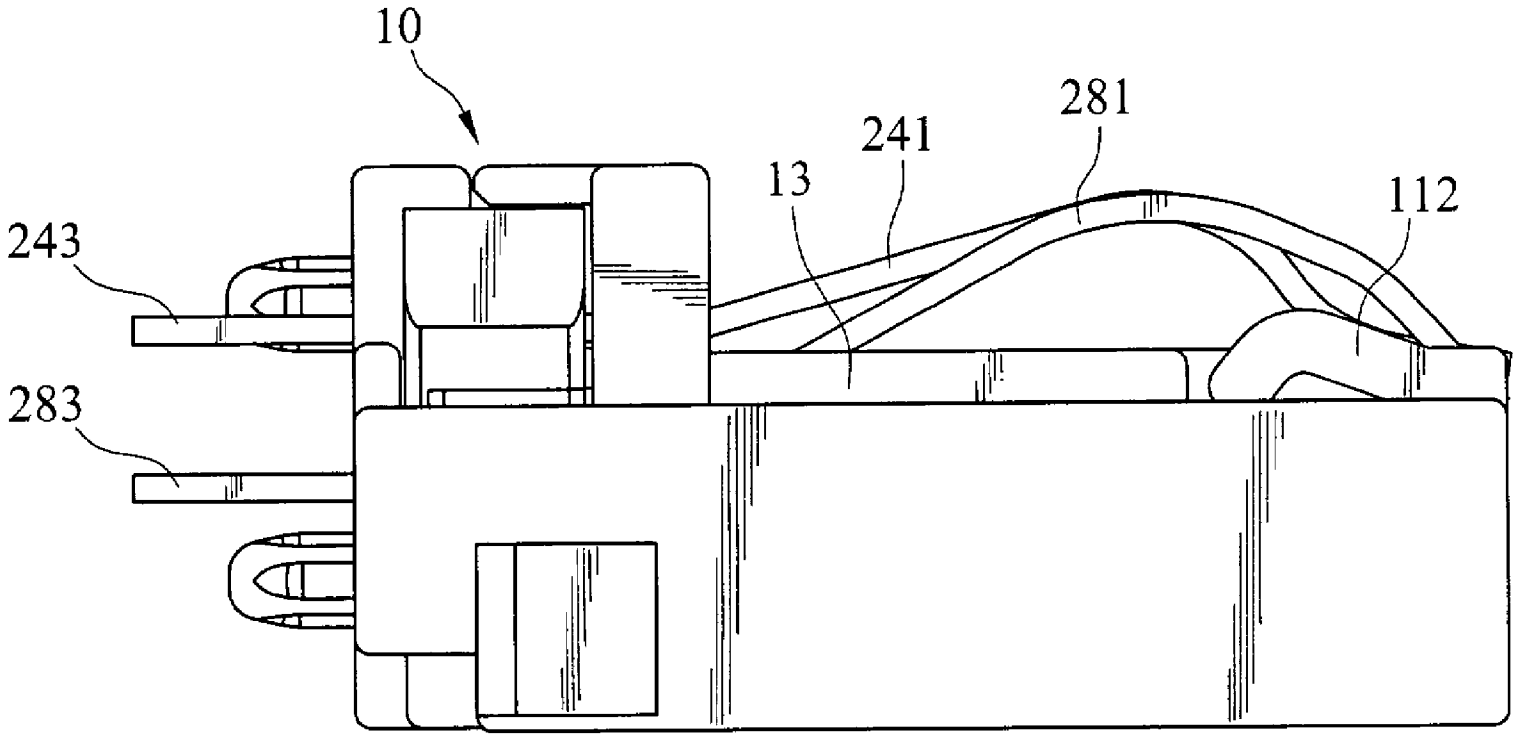
FIG. 7 is another embodiment of the invention.
Figure 8:
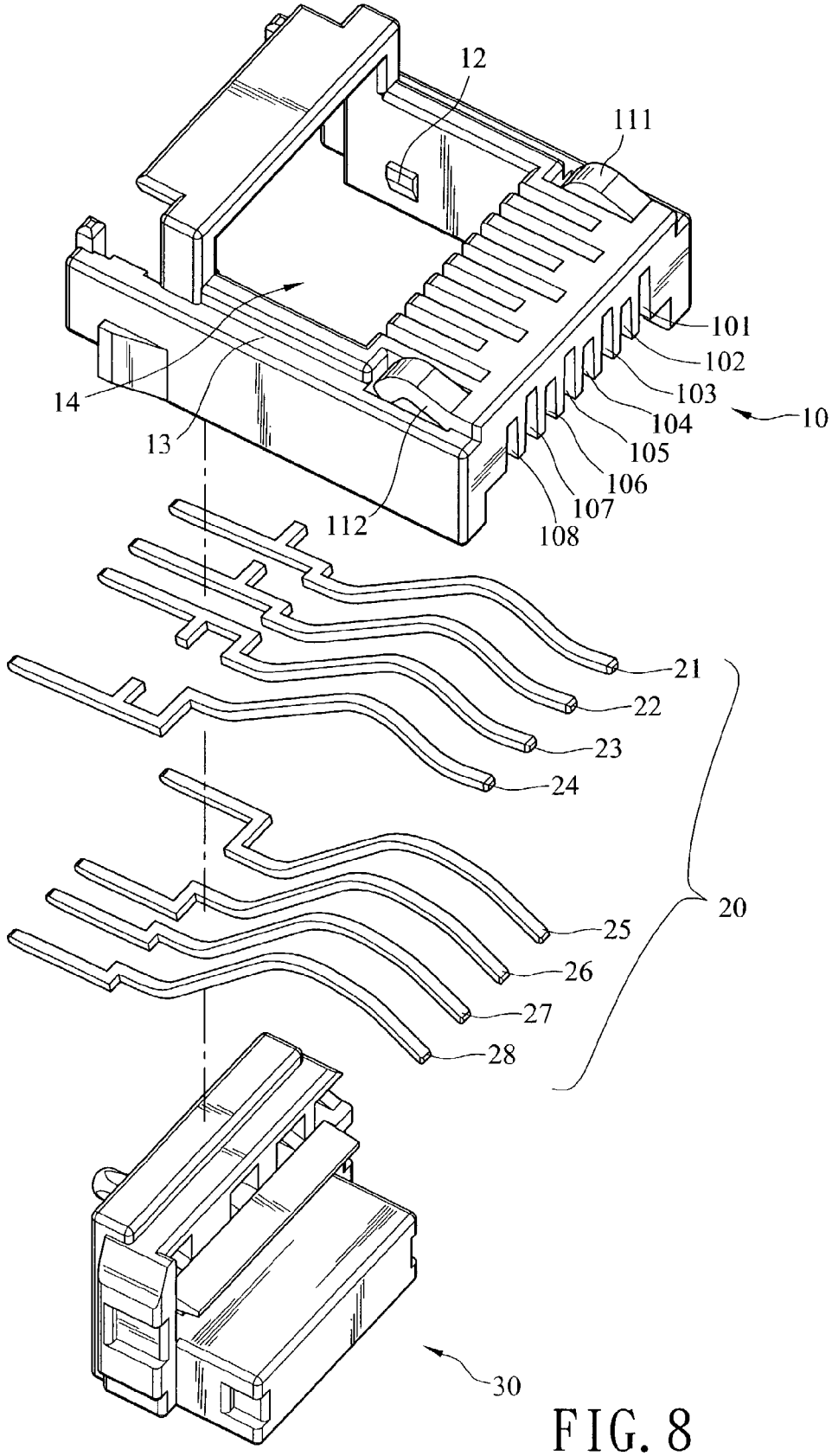
FIG. 8 is a schematic view of the invention where the subtending angle between the connection parts and the network terminal insertion direction is 180 degrees.
Figure 9:
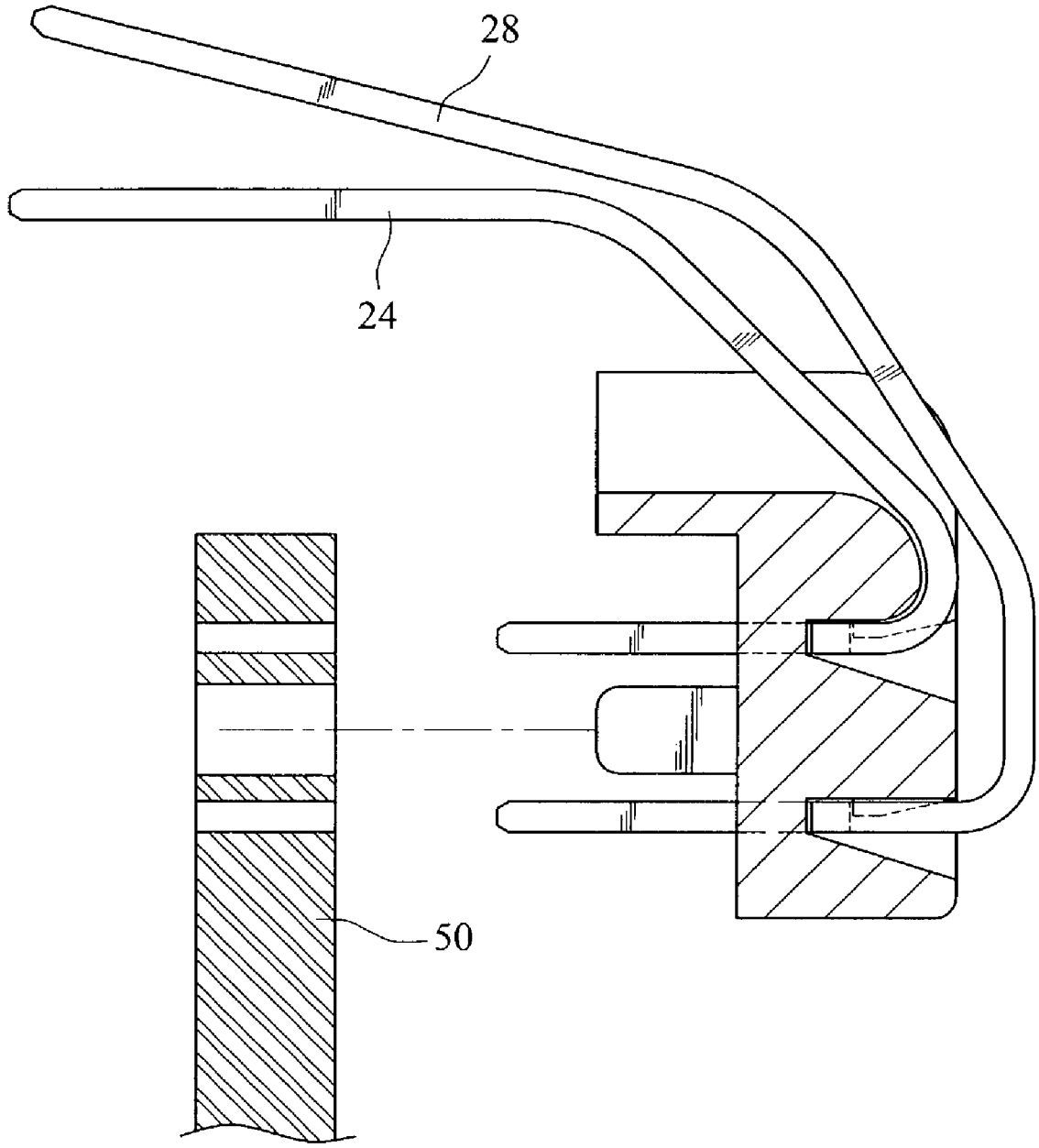
FIG. 9 is a schematic view of the invention where the subtending angle between the connection parts and the network terminal insertion direction is 0 degree.

In the current embodiment, the connection parts 213~283 of the metal wires 21~28 are roughly perpendicular to the plug-in direction of the network terminal plug. One may also design them to parallel to each other, as shown in FIGS. 6 and 7, where the connection parts are 180 degrees from the insertion direction (see FIG. 8). The support 10 has only one end that has several grooves 101~108. FIG. 9 shows another embodiment where the subtending angle is 0 degree. Using only the depressor 30 can still fix the metal wires 21~28. In practice, one can use the connection parts 213~283 to install a connection circuit board 50, which has a corresponding number of poking ends 60 to transmit electrical signals.

Certain variations would be apparent to those skilled in the art, which variations are considered within the spirit and scope of the claimed invention.

What is claimed is:

1. An electrical signal connector comprising:

a depressor having a plurality of holes formed with sideway stop blocks, the plurality of holes extending through a top surface to a bottom surface of the depressor;

and a plurality of metal wires, each of which has a stop part protruding sideways from one end, so that the protruding stop part goes through a corresponding hole and touches against the stop block to avoid departure;

wherein the electrical signal connector further comprising a support so that the metal wires form an elastic part between the support and the depressor;

wherein each of the support has a sliding track for the combination with a cover having a network terminal socket;

wherein the support has more than one clicking button extended upwardly for securing the combination of the cover.

2. The electrical signal connector of claim 1, wherein each metal wire has a protruding bend to enhance its elasticity.

3. The electrical signal connector of claim 1, wherein each metal wire is bent sideways to form the stop part.

4. The electrical signal connector of claim 1, wherein the stop part protrudes from each metal wire.

5. The electrical signal connector of claim 1, wherein the support is provided in such a way to press the metal wires against the depressor.

6. The electrical signal connector of claim 1, wherein the support has at least one end with a plurality of grooves for the metal wires to be installed.

7. The electrical signal connector of claim 6, wherein the grooves of the support are formed with different depths.

8. The electrical signal connector of claim 1, wherein one end of the support has an empty space for the depressor to be installed.

9. The electrical signal connector of claim 8, wherein the empty space of the support has at least one fixing part with a slant surface for the convenience of installing and securing the depressor.

10. The electrical signal connector of claim 1, wherein both ends of the support have a plurality of grooves.

11. The electrical signal connector of claim 1, wherein one end of the elastic conductor goes through the hole on the depressor and exposes to the ambient space, forming a connecting part that is connected to a circuit board.

12. The electrical signal connector of claim 11, wherein the connecting part is roughly 90 degrees from the insertion direction of the network terminal plug.

13. The electrical signal connector of claim 1 further comprising a cover with a network terminal socket for the insertion of a network terminal plug.

14. The electrical signal connector of claim 13, wherein the metal wires form an elastic part on the cover.

* * * * *